US006851400B1

(12) United States Patent
Farrington

(10) Patent No.: US 6,851,400 B1
(45) Date of Patent: Feb. 8, 2005

(54) INTERNAL COMBUSTION ENGINE WITH TRANSLATING CYLINDER

(76) Inventor: Eric Farrington, 1112 Williamsburg Rd., Lancaster, PA (US) 17603

( * ) Notice: Subject to any disclaimer, the term of this patent is extended or adjusted under 35 U.S.C. 154(b) by 0 days.

(21) Appl. No.: 10/437,551

(22) Filed: May 13, 2003

(51) Int. Cl.[7] ..... F02B 59/00
(52) U.S. Cl. ..... 123/42
(58) Field of Search ..... 123/42, 50 R, 123/55.7, 43 R, 47 AB

(56) References Cited

U.S. PATENT DOCUMENTS 1,329,514 A 2/1920 Dusoevoir
4,838,214 A * 6/1989 Barrett ..... 123/41.69
6,032,622 A 3/2000 Schmied
6,314,923 B1 11/2001 Tompkins
2001/0047775 A1 12/2001 Schmied

* cited by examiner

*Primary Examiner*—Tony M. Argenbright
*Assistant Examiner*—Hyder Ali
(74) *Attorney, Agent, or Firm*—Donn K. Harms

(57) ABSTRACT

An internal combustion engine having inline opposing pistons stationarily mounted to a frame. A finned cylinder having a divider therein forming two chambers reciprocates upon the two stationary pistons during operation of the engine to provide power to a device requiring translational or rotational power connected externally. Optionally, the pistons can be formed of front and rear components with the front component being replaceable by mounting it to the rear. A case mounted about the exterior can be vented by an impeller to cool the finned cylinder along with lubricating fluid.

12 Claims, 5 Drawing Sheets

INTERNAL COMBUSTION ENGINE WITH TRANSLATING CYLINDER

FIELD OF THE INVENTION

The disclosed device herein relates to the field of internal combustion engines. More particularly it relates to an internal combustion engine which translates a cylinder between two opposing pistons which are frame mounted in stationary positions. The two pistons provide both a guide for the translating cylinder as well as a mount for igniter and the valves providing intake and exhaust of cylinder gases during operation of the engine. The device as disclosed provides an engine which while compact in dimension, yields exceptional power in relation to that small size and weight.

BACKGROUND OF THE INVENTION

From the advent of the industrialized age, internal combustion engines have provided power to move vehicles, rotate pumps, run generators, and for countless other devices which require a power source to perform work. Generally such engines are conventionally designed to have one or a plurality of pistons attached by rods to a crankshaft and rotate that crankshaft using power developed from combustion of fuel inside the cylinders. A cylinder head conventionally tops the cylinder on this type of engine and provides a mount for valving that allows for injection of fuel and exhaust of gasses from the stationary cylinder during engine operation.

Because of design considerations in conventional internal piston driven internal combustion engines, when multiple pistons are required for more power, they are usually located adjacent or opposite each other. This design while convenient for manufacture, inherently enlarges the overall size of multi-cylinder engines, thus limiting their application due to size concerns. Further, because cooling is always an issue with internal combustion engines due to the extreme heat generated by exploding gases inside the cylinders, complicated liquid or air cooling systems must be provided to cool engines with reciprocating pistons inside adjacent cylinders.

U.S. Pat. No. 1,329,514 (Dusoevoir) describes an internal combustion engine with a translating cylinder. However, Duseovoir is overly elongated due to its design encompassing 4 inline cylinders and requires a very complicated gear and lever system to operate the valves and require the crankshaft to be located in-between the two center pistons to operate the valves and balance the forces. Dusoevoir also lacks any teaching for adequate air or fluid cooling of the reciprocating cylinder.

U.S. Pat. No. 6,314,923 (Tompkins) teaches a two stroke engine with a movable cylinder in-between two pistons. However, Tompkins is a two stroke engine and requires the use of complicated hydraulic or electrotechnical valve actuators and also the use of fuel injectors to operate.

U.S. Pat. No. 6,032,622 (Schmied) teaches an internal combustion cylinder engine having two pairs of chambers. However, Schjmied teaches a two cycle engine of two cycle design with exhaust and intake passages at opposite ends of the cylinder bore with the exhaust located on the cylinder itself, much like the classic two cycle design. Schmied thus lacks the positively sealed and adjustable valve scheme required of a four cycle engine. Schmied would thus be incapable of function as a cleaner four cycle engine and also requires a housing that forms the passage for mounting of the two stationary pistons.

As such, there exists a need for an engine that is compact and provides high energy output in relation to its weight and dimensions. Such an engine should be able to function as a four cycle engine to allow it to run cleaner and cooler. Such an engine should not require any complicated electro mechanic or compressed gas systems to operate but should instead use simple valve activation technology which allowing easy maintenance and operation and also adjustment and enhancement of the engine performance to meet the power requirements. Still further, such a device should be properly cooled to dissipate the heat of internal combustion engine operation as well as provide for a simple manner to communicate the rotational power developed to the device requiring that power.

SUMMARY OF THE INVENTION

The device herein disclosed features a highly compact yet powerful internal combustion engine design. This compact design is enabled by the unique design and operation of the disclosed device which features a translating cylinder having a center wall which laterally translates while engaged on two inline and stationary pistons which communicate in a mount to a block or frame that holds them stationary and inline. Each stationary piston provides a mount for at least one intake and one exhaust port and a spring biased valve to control the seal on those ports. Also provided on each stationary piston is an ignition device such as a spark plug or other gas mixture igniter.

The cylinder is divided into two substantially equally dimensioned cylinder chambers which are sized to sealably engage is over and translate on, the two inline opposing stationary pistons which are connected directly or indirectly to a block or frame holding them in position. A first ring on each piston provides for enhanced sealing and compression while a second oiling ring provides lubrication to the cylinder piston engagement through a passage communicating through the respective piston on which it is mounted.

Functioning as a four cycle engine, the translating cylinder is attached to a drive gear using an external rod which communicates between an exterior surface mount on the translating cylinder at a first end to a gear drive at a second end. The rod is rotationally attached to the gear drive such that translations of the cylinder over and between the pistons will rotate the gear drive. The translations of the cylinder over the pistons is divided equally into power strokes and exhaust strokes as is the case with conventional four cycle engines and imparts power to the drive gear on each power stroke and oils the respective piston and cylinder engagement on each exhaust stroke. Since the two pistons are inline and opposed to each other, every time one piston and cylinder combination is operating on a power stroke, the other is operating in the exhaust stroke. Thus, there is a constant even supply of power to the drive gear from the cylinder since there is always a power stroke from one or the other pistons engaged with one or other of the cylinder chambers.

The cylinder is divided at substantially a center point by a divider plate which is substantially normal to the center axis of the cylinder. This divider plate thus forms two substantially equally dimensioned cylinder chambers, each sized to sealably engage and laterally translate upon one of the opposing two stationary pistons.

The exterior surface area of the cylinder in the current favored embodiment of the device has a plurality of grooves about the entire circumference of the cylinder. This grooved surface substantially increases the surface area of the circumference of the exterior of the cylinder and enhances the cooling of the cylinder which is accomplished by oil and air washing over the exterior surface. Also in a current favored embodiment the two pistons have forward sections which are mounted to an underlying piston mounts serving as rearward sections which are fixedly attached to an engine block or frame to allow for easy installation and replacement of either piston if damaged or in need of maintenance. The pistons are in registered engagement with the underlying block or frame using dowels or other locating mutually engageable components which allow for a registered engagement of the pistons with the underlying block which also provides a substantially inline alignment of the two pistons along the center axis of the cylinder. The pistons would also have appropriately located passages to allow for alignment of the intake and exhaust ports of the pistons with those exiting on the engine block or frame side. Using this mode of mounting, should either of the pistons become damaged, it can be easily replaced and aligned with the opposing piston and with the intake and exhaust ports of that piston.

As noted, the cylinder is attached to a drive gear or wheel which is attached to a drive shaft. At least one of the drive wheels would be adapted on its exterior circumference with teeth or the like for engagement with an exterior device whereby rotational power from the engine would be communicated thereto. A first drive wheel would be on one end of the drive shaft and on the opposite end of the drive shaft is a second drive wheel attached to a second rod which is rotationally engaged with the cylinder on the opposite side from the first rod. Two rods thus impart balanced force to the two drive gears and the communicating drive shaft.

The valves in the device are operated by cam gears engaged with individual cam shafts. One cam gear is in direct engagement with the drive shaft while the second is engaged using a chain or belt or similar apparatus that allows both of the camshafts to be rotated and open and close the two valves at the proper time intervals required for the compression and exhaust of the engine. The valves on each piston open and close in sealed engagement with valve seats that are formed in the face of each respective piston and thereby provide intake and exhaust gas ports for each individual piston and cylinder engagement.

In the favored embodiment a case surrounds the block or frame which serves as the mount for the inline pistons as well as surrounding the cylinder and other components. The case is tilled with oil to lubricate and cool the cylinder and piston during operation and in the current favored embodiment air is also circulated through the case by an impeller linked to the crankshaft which powers it during operation of the engine.

An object of this invention is the provision of an internal combustion engine wish a high power to weight ratio.

Another object of this invention is to provide an engine which uses two stationary pistons providing mounts for the valving system and an inline path on which a moveable cylinder traverses.

An additional object of this device is the provision of a high power output engine that is easily cooled using a finned exterior on the oscillating cylinder.

A further object of this device is to provide an easily maintainable internal combustion engine using pistons that easily mount in a registered inline engagement thus enhancing replacement of parts should they be needed.

Yet an additional object of this device is the provision of such an inline piston engine which provides finned cylinder which is easily cooled by oil and air traversing through a case enclosure.

These together with other objects and advantages which will become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
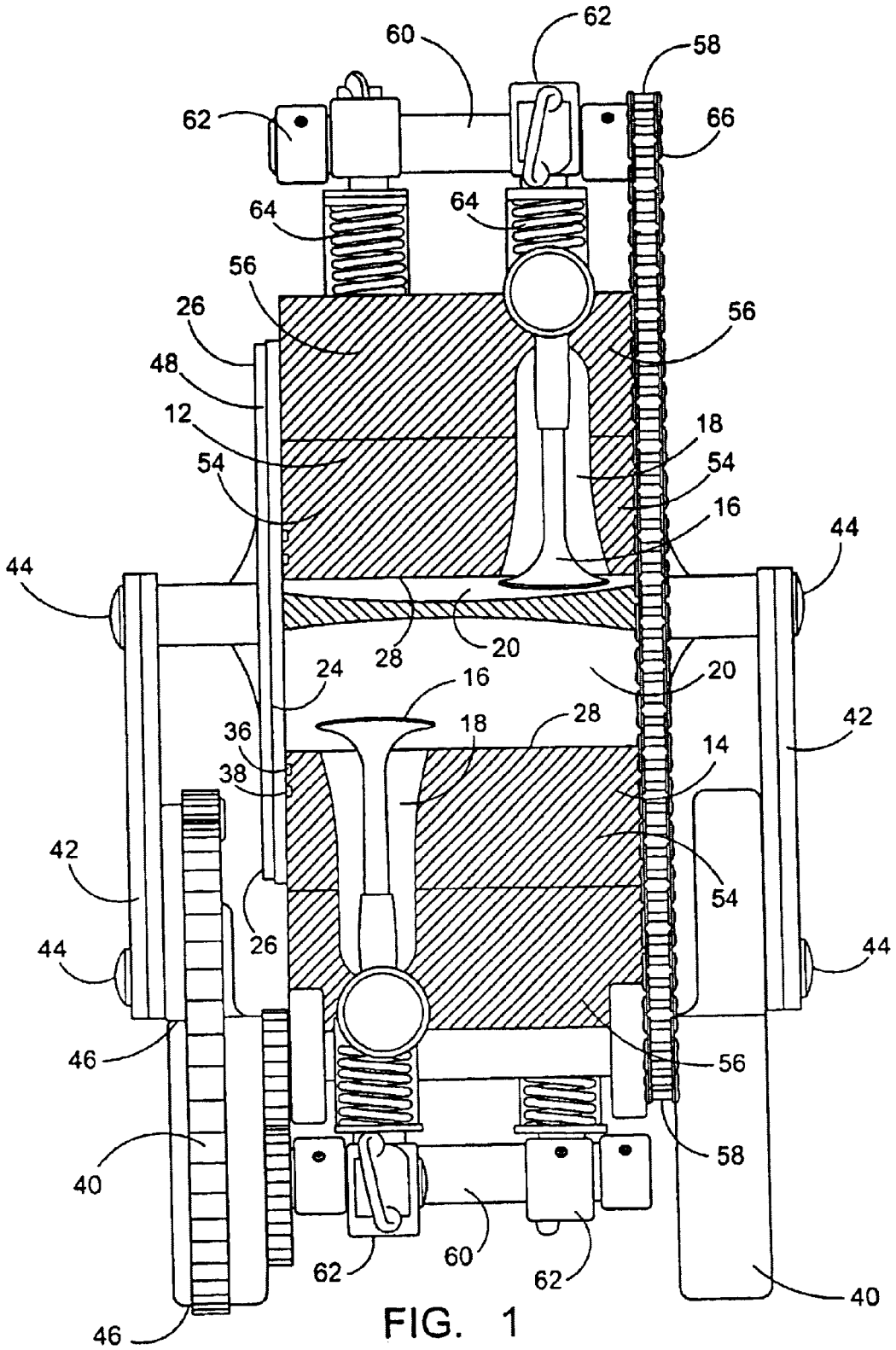
FIG. 1 depicts a side view of the disclosed device showing the engagement of the cylinder over two inline pistons and the engagement of other components of the device.
Figure 2:
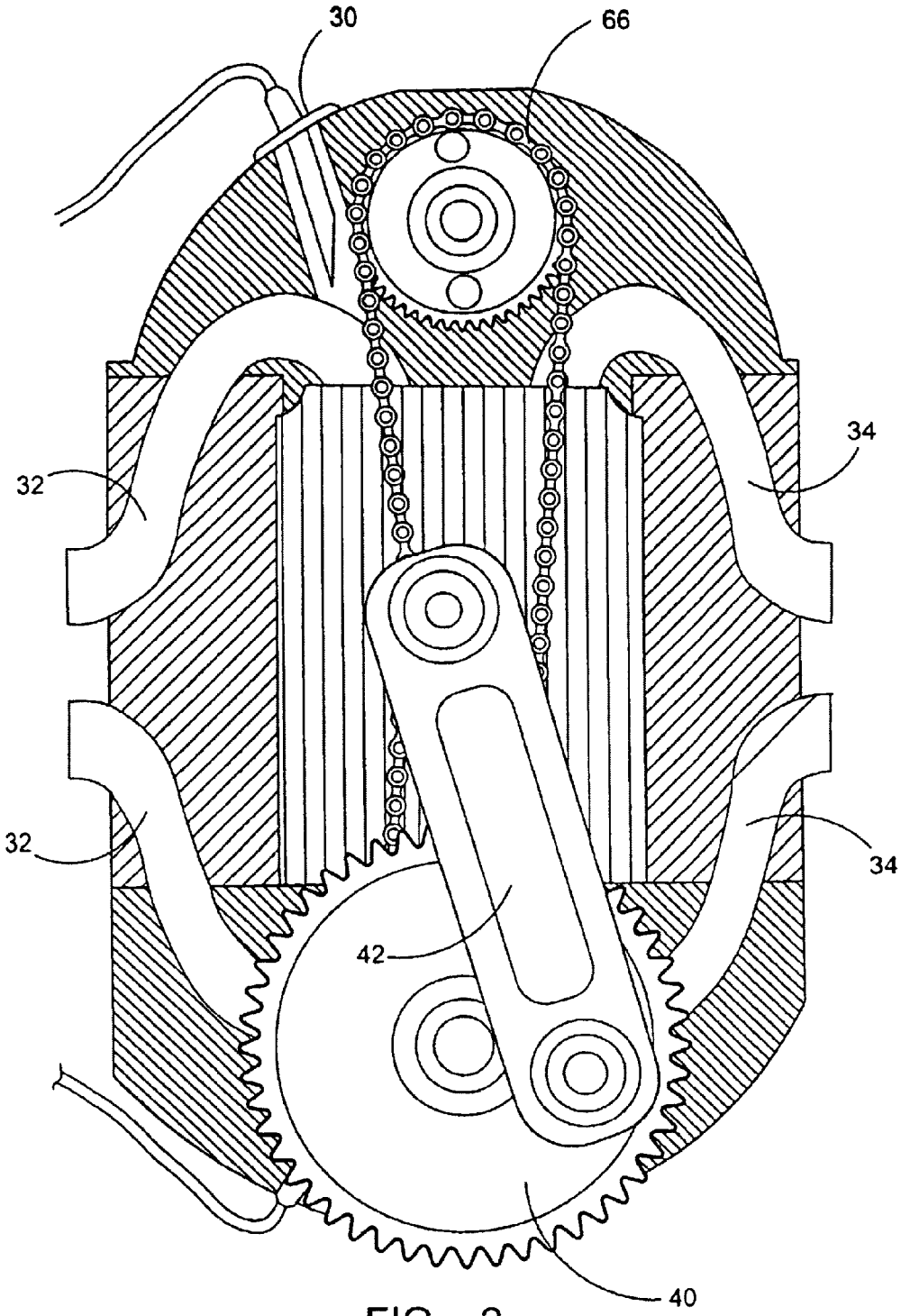
FIG. 2 depicts a second side view showing the engagement of the cylinder with the drive gear and chain driven top camshaft.
Figure 3:
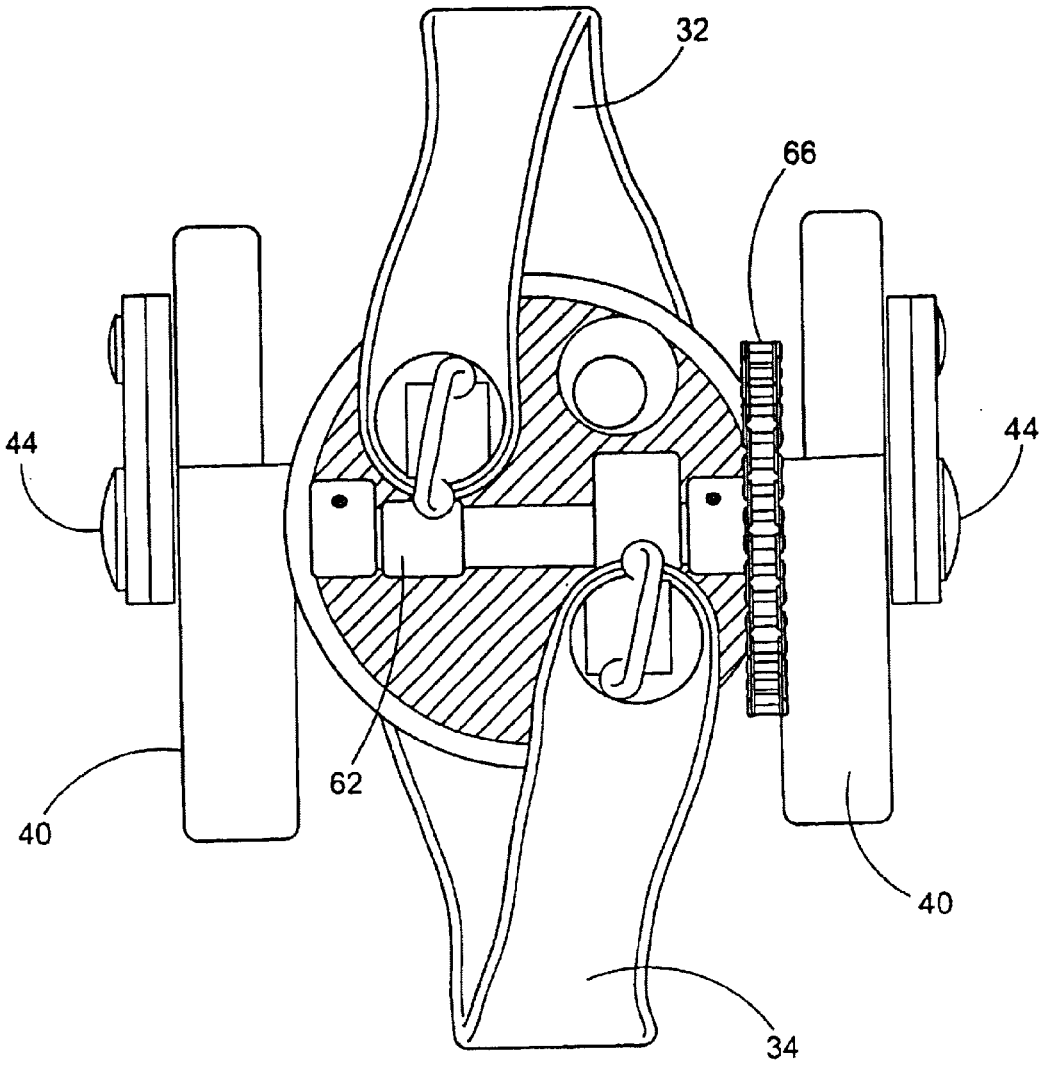
FIG. 3 depicts and end view of the device showing the valve seat formed in the face of one of the two opposing pistons.
Figure 4:
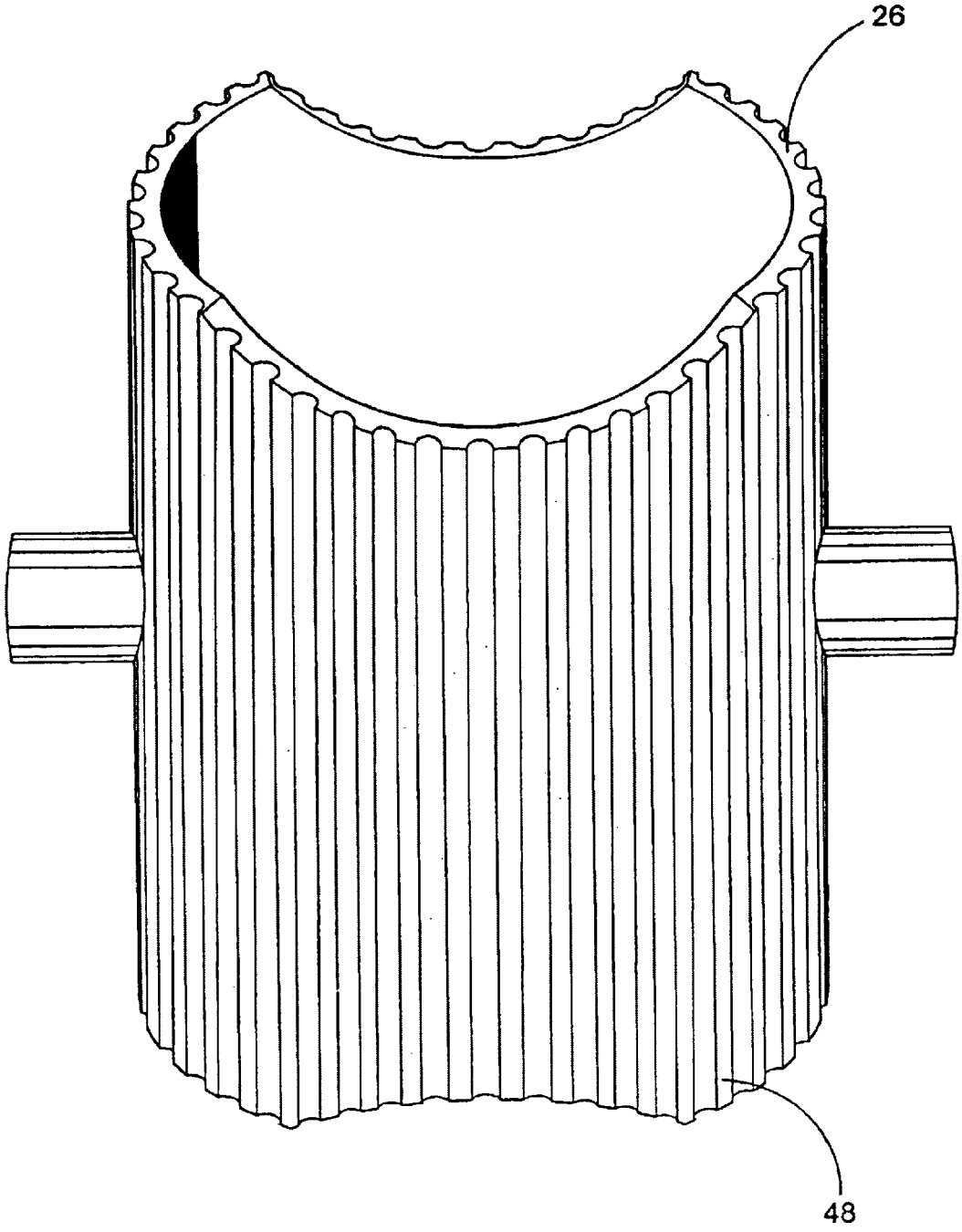
FIG. 4 depicts the grooved exterior surface of the cylinder to aid in cooling.
Figure 5:
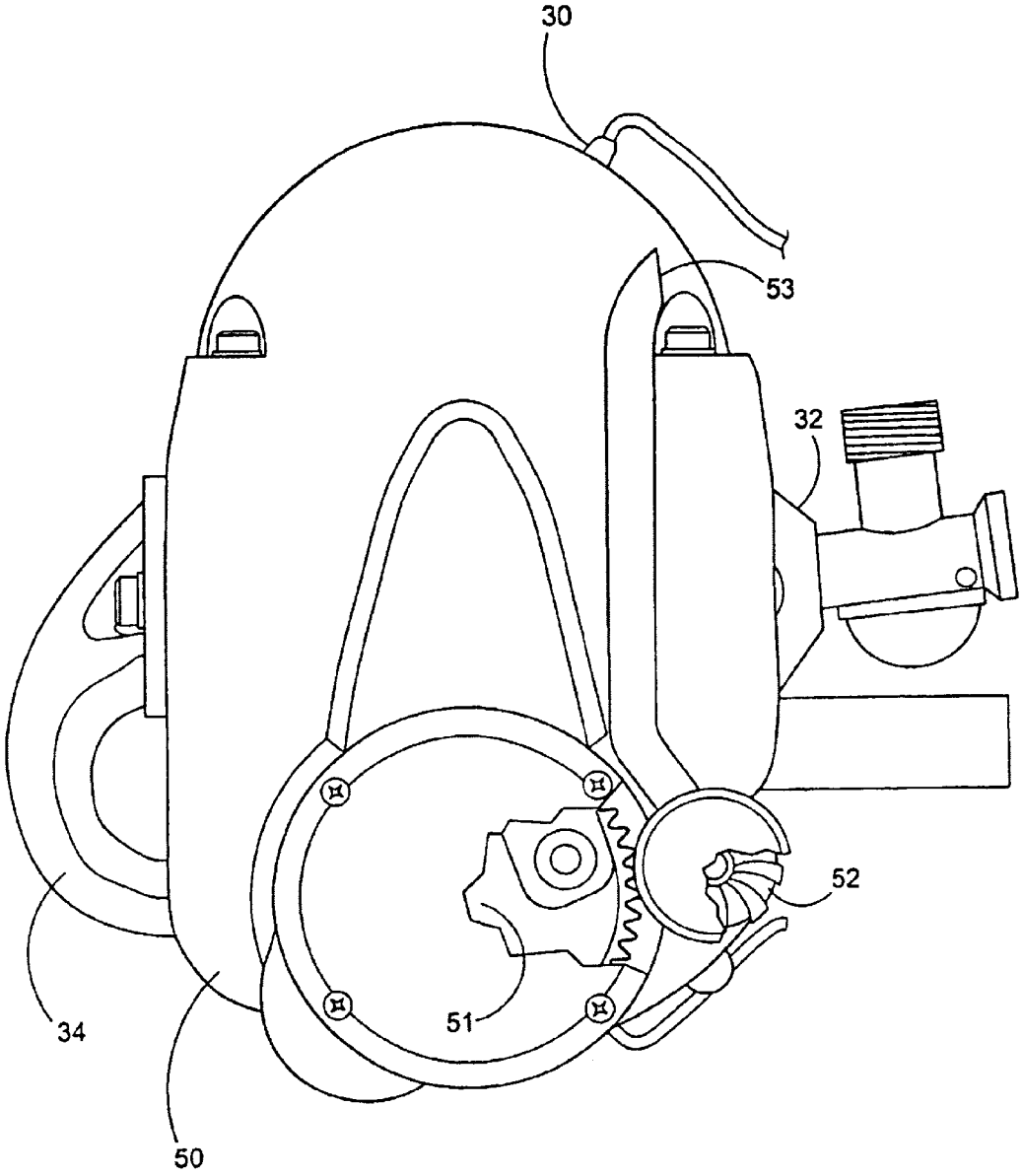
FIG. 5 depicts a side view of the engine encased in an exterior case which provides a reservoir for oil and also aids in cooling through the provision of a impeller blade to pump air through the internal cavity.

Referring now to the drawings in FIGS. 1–5 wherein similar parts of the invention are identified by like reference numerals, there is seen in FIG. 1 disclosed engine device 10. The device 10 features a first piston 12 and second piston 14 held in a stationary and in-line opposing position by attachment to a block or a frame or similar means for stationary inline mounting of the two pistons 12 and 14. Each piston has a pair of valves 16 operatively situated in valve ports 18 which both communicate with the face of the respective pistons. Of course more valves could be provided for increased flow and such is anticipated. The valve ports 18 function in the conventional fashion with one providing the intake mixture of fuel and air to the combustion chambers 20 which are situated on each side of a compression plate 22 which is mounted substantially at the middle of the laterally translating cylinder 26. The two combustion chambers 20 have an area defined by the sidewall 24 of the cylinder 26, the compression plate 22, and the face 28 of the respective pistons 12 and 14 when the cylinder is engaged thereover in an operational translational relationship.

By placing the pistons 12 and 14 in a stationary position attached to the block or frame, with their respective center axis and circumferences in-line, and translating the cylinder 26 upon the two stationary pistons 12 and 14, a very compact two cylinder engine is achieved. Since the compression plate 22 is situated substantially at the center of the cylinder 26, the two combustion chambers 20 have substantially equal volume and hence substantially equal compression of the fuel mixture when the cylinder 26 translates toward each individual piston 12 and 14 during the compression stroke as best depicted in FIG. 1 where the cylinder 26 has translated furthest toward the first piston 12 with the compression plate 22 at its closest point to the face 28 of the first piston 12.

When the mixture in either the combustion chambers 20 is compressed and then is ignited by a means for ignition of the fuel mixture such as a spark plug 30, the explosion forces the compression plate 22 and attached cylinder 26, toward the opposing piston 14 and in that travel compresses the fuel mixture in the opposing combustion chamber 20 in front of the face 28 of the second piston 14 which is then ignited by the means for ignition such as a spark plug 30 and the cycle repeats itself.

The fuel mixture feeding both combustion chambers 20 would be provided by a means to mix fuel and air and communicate it to the combustion chamber 20 such as fuel injectors, a throttle body injector, or a carburetor or the like, communicating through an intake manifold 32 in direct or other communication with the valve 16 and valve port 18 which serves as the intake valve through each piston 12 and 14. Exhaust gases from the spent fuel mixture in each respective combustion chamber 20 are communicated to an exhaust pipe 34 which communicates through the valve 16 serving as the exhaust valve in its valve port 18 in each respective combustion chamber 20.

As noted, the cylinder 26 translates and is divided into two substantially equally dimensioned combustion chambers 20 which are sized to sealably engage over and translate on the two opposing stationary pistons 12 and 14. A first ring 36 on each piston 12 and 14 provides for enhanced sealing and compression while a second oiling ring 38 provides lubrication to the sidewall 24 and piston engagement from a lubrication passage communicating through the respective piston on which it is mounted of course those skilled in the art will realize that other ring engagements are possible and such are anticipated operating in a preferred mode similar to the manner of side by side four cycle engines with both a compression and lubrication or exhaust stroke, the laterally translating cylinder 26 is operatively attached to a drive wheel 40 using an external rod 42. The rod 42 is rotationally engaged at a first end on a pivot 44 or similar rotational mount protruding from its attachment to the exterior surface of the translating cylinder 26. The rod 42 extends down to a rotational mount at a second end to a position off center on the drive wheel 40. There are in a current preferred embodiment of the device, two rods 42 rotationally attached to the exterior of the cylinder 26 extending to a rotational mount on two respective drive wheels 40. Of course one rod and wheel engagement might work; however using two preserves the delicate balance required when operating internal combustion engines at high speed and enhances strength. The provision of the drive wheels 40 and rods 42 in matched pairs provides further balance to the operation of the device 10 as well as increased strength to the connection between the cylinder 26 when forced to translate and the rotating drive wheels 40.

Communication of power from the device 10 to perform work would be provided by a means of communication of rotational power from the rotating drive shaft from at least one of the drive wheels 40 to a component requiring the power. In the current preferred embodiment of the device 10, a drive gear 46 is situated about the exterior circumference of at least one of the drive wheels 40. This drive gear 46 would have teeth adapted for cooperative operative engagement with a component to be rotationally driven by the power from the device 10 such as a vehicle or pump or generator the like.

Cooling to the device 10 is enhanced in a current preferred mode by a dual cooling scheme which act in concert to transfer heat from a plurality of fins 48 on the exterior surface of the cylinder 26. Provision of this plurality of fins 48 and the resulting grooves in-between substantially increases the surface area of the exterior circumference of the exterior surface of the cylinder 26 thus providing an increased area from which to communicate heat from the internal combustion in the two combustion chambers 20 during the power stroke. Heat so radiated is communicated away from the cylinder 26 using one or a combination of air cooling and oil cooling of the cylinder 26 with both being the current preferred operation due to the increased cooling capacity of two forms of heat transference.

Fluid cooling is provided by the oil which is held inside the sealed case 50 splashes upon the fins 48. The oil splashing on and running down the exterior of the fins 48 would absorb and relocate heat therefrom. The oil collecting in the bottom of the case can also be routed to a cooler if the case were adapted for such and such an oil cooling scheme is anticipated, especially in hot climates or for engines under high load. Cooling is further enhanced as noted, by air which is circulated through the interior of the case 50 and impeller 52 operatively engaged with the drive gear 46. This impeller would pull cool air in from the exterior of the case 50 and exhaust it from the case at an air exhaust port 53 in the upper portion of the case to exhaust heat but not oil of course the impeller 52 would spin faster as the engine goes faster thereby providing more cooling. This air circulation would cool both the fins 48 and the cylinder as well as the oil flying about and on the fins 48, thus providing enhanced cooling of the device 10 during operation.

A preferred but optional enhancement of the device 10 is the provision of replaceable pistons 12 and 14 in case of wear and tear. This is provided by adapting a front portion 54 of each piston 12 and 14 to a registered engagement with an underlying mounting portion 56 a means for registered engagement thereof with the valve ports 18 aligned and pistons 12 and 14 operatively aligned such as alignment pins or dowels. This would allow for easy replacement of the front portions 56 and maintaining their alignment with each other. The mounting portion 56 might be formed as part of the block or frame holding the pistons 12 and 14 or might be a separate component that itself attaches to an underlying block or frame. Of course those skilled in the art will realize that the device 10 would function without this optional replacement ability and such is anticipated; however, a preferred mode of the device 10 would be enhanced for servicing by this ability to easily attach new front portions 56 of the pistons 12 and 14 in a registered and inline engagement.

The valves 16 operating to control gas intake and exhaust in this disclosed device 10 are operated by cam gears 58 engaged with individual cam shafts 60 or in the case of the lower cam shaft 60 by direct engagement with one drive wheel 40. The rotation of the cam shafts 60 rotates cam lobes which activate rocker arms 62 which translate the respective valves 16 in their respective valve ports 18. The valves 16 are biased to a closed position by default by valve springs 64. The cam shaft 60 not directly engaged to a drive wheel 40 is rotated to time the opening and closing of the valve 16 properly using a chain 66 or belt or similar apparatus that allows both of the camshafts to be rotated and open and close their two respective valves 16 at the properly timed intervals required for the compression and exhaust strokes of the engine of course other means for timed opening and closing of the intake valves and exhaust valves might be used such as solenoids, or hydraulically activated valves 16; however, the preferred mode of the device uses the valves 16 operated by the cam shaft 60 for simplicity and reliability.

In operation, a case 50 would surround the frame or block which supports the pistons 12 and 14 in their stationary engagement as well as the cylinder 26 and other components of the device 10. The case 50 as noted would be filled with sufficient lubricant such as engine oil to lubricate the gears, valves, and other moving components, and to cool the fins 48 formed on the exterior of the cylinder 26. Additionally, air circulated by the impeller 52 would be forced into the interior cavity 51 defined by the case and allowed to vent from the case 50 in a manner to allow sufficient air flow into and out of the device 10 to aid in cooling. The exterior of the case 50 would be adapted for engagement with a mount to hold the device 10 upright and either attached to the device it powers or mounted upright to sit upon a surface during operation. Also, it is anticipated that the device 10 can be constructed with the pistons 12 and 14 held in place and inline by the case 50 itself which would function as the frame to hold the various components in their respective positions.

The device herein shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described, may be employed in accordance with the spirit of this invention. All such changes, alterations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the scope of the invention as set forth in the following claims.

What is claimed is:

1. An internal combustion engine comprising:

a first piston, said first piston having an exterior and a center axis communicating between a face and a mounting end opposite said face;

a second piston, said second piston having a center axis communicating between a face and a mounting end opposite said face;

frame means to engage said mounting end of said first piston and said mounting end of said second piston, said frame means thereby holding said first piston and said second piston in a stationary position with their respected faces separated and center axis of said first piston substantially inline with said center axis of said second piston;

a cylinder, said cylinder having a side wall, said sidewall having an interior surface defining an internal cavity and having an exterior surface;

a divider engaged with said interior surface of said sidewall and separating said internal cavity into two cylinder chambers;

said interior chambers dimensioned to cooperatively engage with an exterior surface of said first piston and said second piston thereby allowing said cylinder to translate upon said first piston and said second piston;

means for induction of a fuel air mixture into said cylinder chambers through said face of said first piston and said second piston;

means to ignite said fuel air mixture inducted into said cylinder chambers and thereby force said cylinder toward the opposite piston thereby translating said cylinder on said pistons between a compression position with said divider closest to one of said first piston and said second piston, to a translated position, with said divider closest to the opposite of said first or second piston;

means to exhaust spent fuel and air mixture from said cylinder chambers through said face of said first piston and said second piston and to the atmosphere subsequent to ignition by said means to ignite;

at least one rod having first and second ends, said first end rotationally engaged to said exterior surface of said cylinder sidewall;

a wheel attached to an axle;

said second end of said rod engaged with said wheel to thereby rotate said wheel when said rod is translated by said reciprocating cylinder;

means to engage at least one of said wheel and said axle with a device requiring power; and whereby said cylinder will reciprocate between and engaged upon, said first and second pistons, when said fuel mixture is ignited sequentially, thereby causing said second end of said rod to translates and communicate power from said reciprocating cylinder to said device.

2. The internal combustion engine of claim 1 wherein said means to engage said wheel with said device requiring power comprises:

at least one of said wheel or said axle having a geared circumference, said geared circumference engageable with a geared component from said device requiring power to communicate rotational power thereto.

3. The internal combustion engine of claim 2 additionally comprising:

said exterior surface of said cylinder having fins; and means to cool said cylinder provided by said fins moving through air during translation of said cylinder.

4. The internal combustion engine of claim 3 additionally comprising:

a case, said case having an interior wall surface defining an interior cavity, and having an exterior wall surface;

said interior cavity dimensioned to surrounding said cylinder and allow said cylinder to reciprocate upon said first piston and said second piston;

means to pump air external from an intake aperture communicating through said case, through said interior cavity and through an exit aperture communicating through said case; and whereby cooling efficiency of said fins is enhanced by air flow through said interior cavity.

5. The internal combustion engine of claim 4, additionally comprising:

said interior cavity of said case providing a reservoir for lubricating fluid; and said lubricating fluid providing an additional cooling means to said fins from splash thereon during operation of said internal combustion engine.

6. The internal combustion engine of claim 3 additionally comprising:

said first piston and said second piston both being formed of a first component and a second component;

said first component extending from said mounting end to a mounting face;

said second component extending from said face to an attachment face; and means for registered engagement of said attachment face to said mounting face with said center axis of said first piston substantially aligned with said center axis of said second piston, whereby said second component of each of said first piston and said second piston, is replaceable.

7. The internal combustion engine of claim 6 additionally comprising:

at least one compression sealing ring attached to said first component of both of said first piston and said second piston whereby changing said first component also replaces said sealing ring.

8. The internal combustion engine of claim 1 additionally comprising:

said exterior surface of said cylinder having fins; and means to cool said cylinder provided by said fins moving through air during translation of said cylinder.

9. The internal combustion engine of claim 8 additionally comprising:

a case, said case having an interior wall surface defining an interior cavity, and having an exterior wall surface;

said interior cavity dimensioned to surrounding said cylinder and allow said cylinder to reciprocate upon said first piston and said second piston;

means to pump air external from an intake aperture communicating through said case, through said interior cavity and through an exit aperture communicating through said case; and whereby cooling efficiency of said fins is enhanced by air flow through said interior cavity.

10. The internal combustion engine of claim 9 additionally comprising:

said interior cavity of said case providing a reservoir for lubricating fluid; and said lubricating fluid providing an additional cooling means to said fins from splash thereon during operation of said internal combustion engine.

11. The internal combustion engine of claim 1 additionally comprising:

said first piston and said second piston both being formed of a first component and a second component;

said first component extending from said mounting end to a mounting face;

said second component extending from said face to an attachment face; and means for registered engagement of said attachment face to said mounting face with said center axis of said first piston substantially aligned with said center axis of said second piston, whereby said second component of each of said first piston and said second piston, is replaceable.

12. The internal combustion engine of claim 11 additionally comprising:

at least one compression sealing ring attached to said first component of both of said first piston and said second piston whereby changing said first component also replaces said sealing ring.

* * * * *